US007434853B2

(12) United States Patent
Yamamoto et al.

(10) Patent No.: US 7,434,853 B2
(45) Date of Patent: Oct. 14, 2008

(54) DOOR LATCH APPARATUS

(75) Inventors: Etsuo Yamamoto, Yamanashi (JP); Michio Ohashi, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 0 days.

(21) Appl. No.: 11/350,074

(22) Filed: Feb. 9, 2006

(65) Prior Publication Data

US 2006/0202485 A1 Sep. 14, 2006

(30) Foreign Application Priority Data

Mar. 14, 2005 (JP) ..... 2005-071071

(51) Int. Cl.
*E05C 3/06* (2006.01)
*E05C 3/00* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS 5,288,115 A * 2/1994 Inoue et al. ..... 292/201
6,422,615 B1 * 7/2002 Roos et al. ..... 292/216
6,499,776 B2 * 12/2002 Takamura ..... 292/201

FOREIGN PATENT DOCUMENTS

| | | | |
|---|---|---|---|
| EP | 0 321 958 | A3 | 6/1989 |
| GB | 2 237 060 | A | 4/1991 |
| GB | 2 276 665 | A | 10/1994 |
| GB | 2 287 280 | A | 9/1995 |
| JP | 1-151678 | A | 6/1989 |
| JP | 3390650 | B2 | 1/2003 |

* cited by examiner

*Primary Examiner*—Carlos Lugo
*Assistant Examiner*—Kristina R Fulton
(74) *Attorney, Agent, or Firm*—Foley & Lardner LLP

(57) ABSTRACT

A door latch apparatus closes a door of a vehicle by, when a striker and a latch are in a first engagement state, shifting the striker and the latch into a second engagement state through an effective operation of an output lever by driving an actuator. When the shift of the striker and the latch into the second engagement state is restricted, the output lever is allowed to perform a retracting operation by driving the actuator.

14 Claims, 16 Drawing Sheets

DOOR LATCH APPARATUS

BACKGROUND OF THE INVENTION

1. Field of the Invention

The present invention relates to a door latch apparatus that closes a door of a vehicle by, when a striker and a latch are in a first engagement state, transiting the state of the striker and the latch into a second engagement state.

2. Description of the Related Art

Various types of door latch apparatuses are applied to recent four-wheel vehicles. Some of the door latch apparatuses have a function that automatically brings a door of a vehicle having undergone an opening operation into a fully closed state. In this type of door latch apparatus, a latch mechanism is provided with an actuator. When a striker and a latch are brought into a half-latch state by closing the door, the latch is operated in such a manner that the striker is drawn inward by driving the actuator, and the striker and the latch are operated to reach a full-latch state, and, as a result, the door is kept in the fully-closed state with respect to a main body of the vehicle (see, for example, Japanese Patent No. 3390650).

However, in the above door latch apparatus, it becomes difficult to shift the striker and the latch from the half-latch state to the full-latch state, when a foreign object is nipped between the main body and the door. As a result, a power transmitting system that transmits a driving force to the latch becomes inoperable in spite that the actuator is being driven, and an overload may be imposed on the power transmitting system, which may damage the system.

SUMMARY OF THE INVENTION

It is an object of the present invention to at least solve the problems in the conventional technology.

A door latch apparatus according to one aspect of the present invention closes a door of a vehicle by, when a striker and a latch are in a first engagement state, shifting the striker and the latch into a second engagement state through an effective operation of an output lever by driving an actuator. When the shift of the striker and the latch into the second engagement state is restricted, the output lever is allowed to perform a retracting operation by driving the actuator.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described below in detail with reference to the accompanying drawings.

Figure 1:
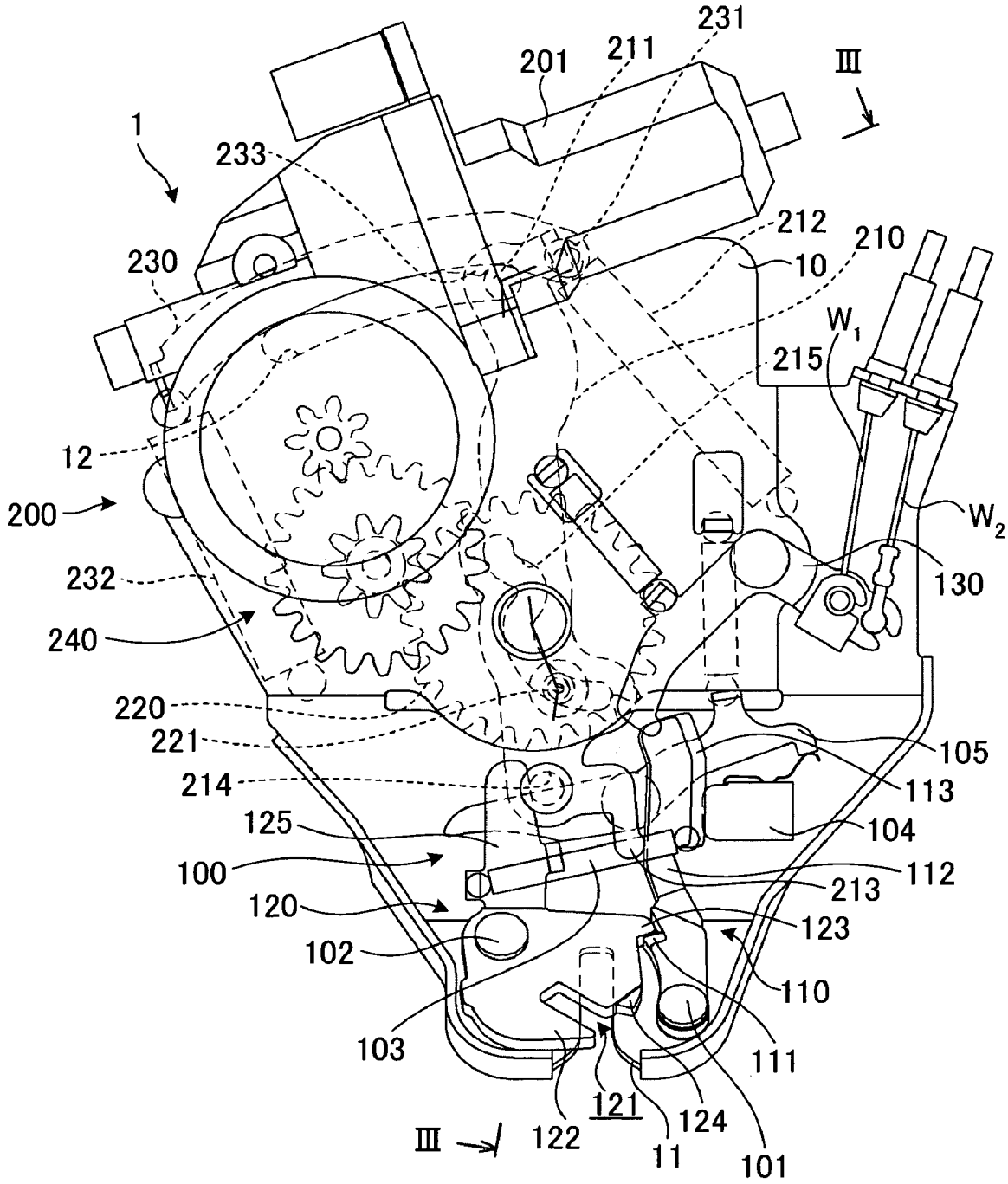
FIG. 1 is a front view of a door latch apparatus according to an embodiment of the present invention.
Figure 2:
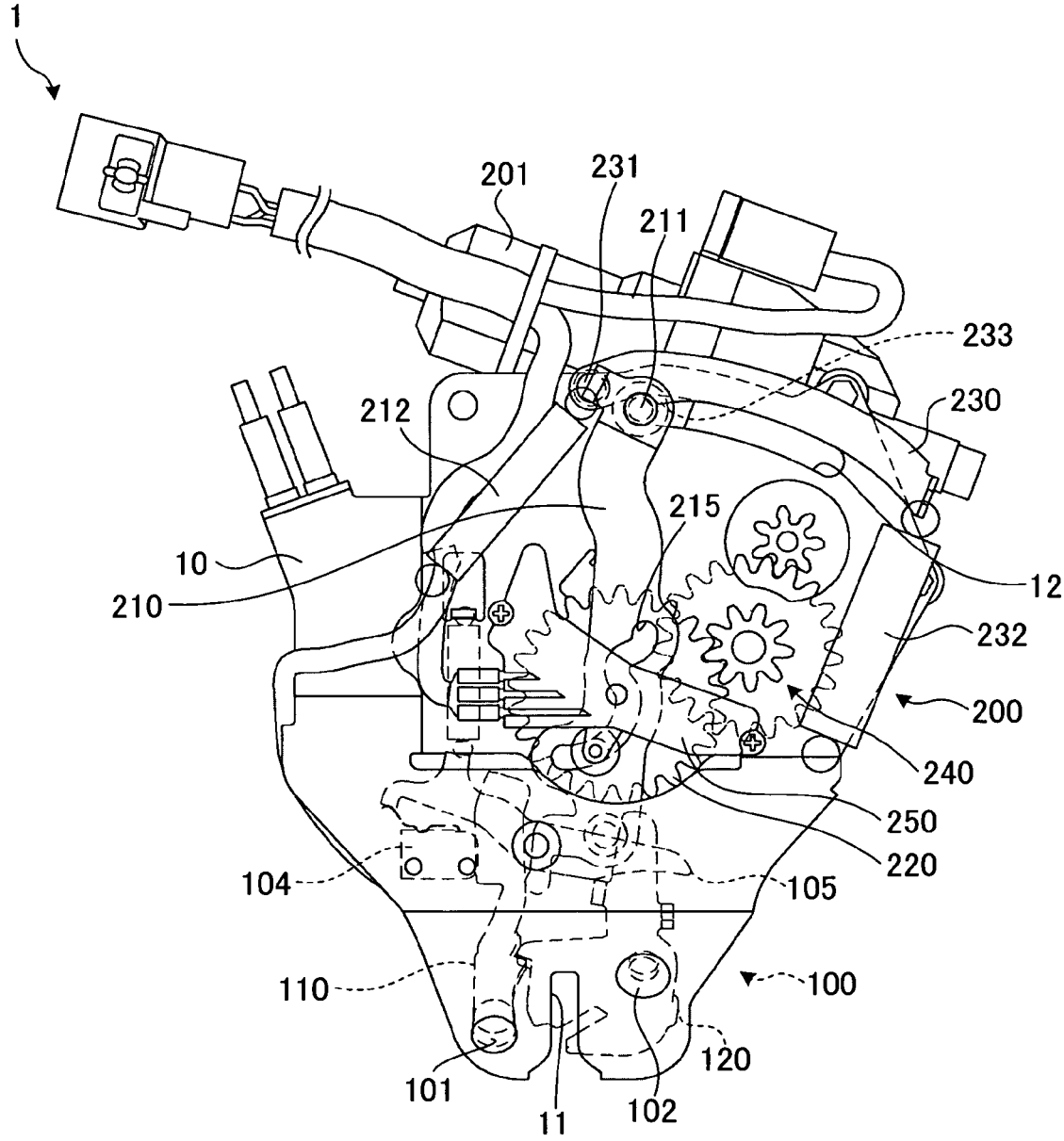
FIG. 2 is a rear view of the door latch apparatus.
Figure 3:
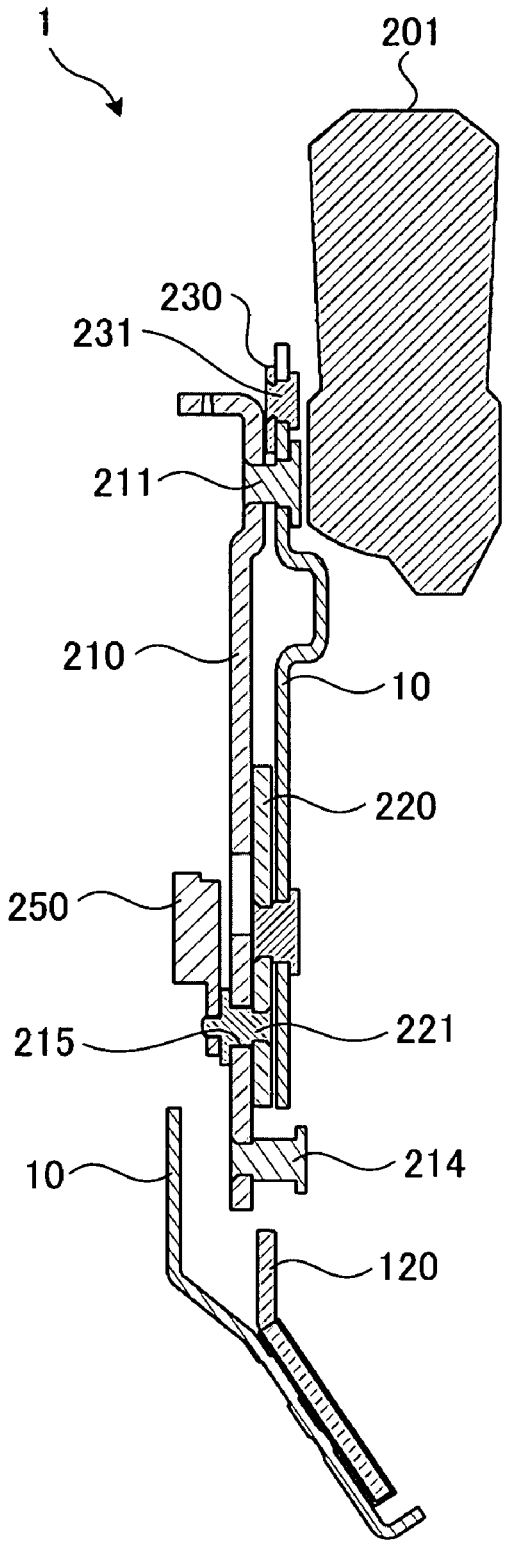
FIG. 3 is a cross section of the door latch apparatus, cut along a line III-III shown in FIG. 1.
Figure 4:
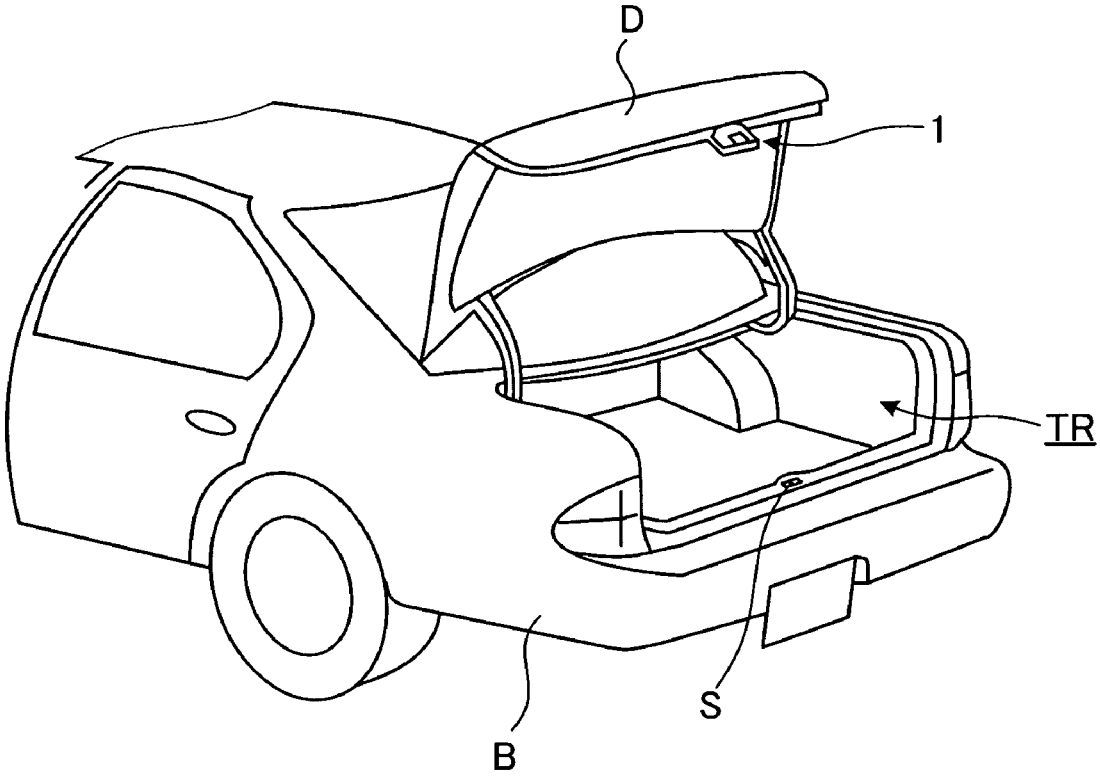
FIG. 4 is a perspective view of a vehicle to which the door latch apparatus is installed.

FIGS. 1 to 3 are schematics of a door latch apparatus 1 according to an embodiment of the present invention. The door latch apparatus 1 is applied to a door (hereinafter, "trunk lid D") for opening and closing a trunk room TR provided in the main body B of a vehicle as shown in FIG. 4, and is used to keep the trunk lid D in a closed state. According to the present embodiment, a sedan type four-wheel vehicle is shown in the figure as an example. In this vehicle, a striker S is fixed to the main body B of the vehicle, whereas the door latch apparatus 1 is provided on the trunk lid D.

The door latch apparatus 1 includes a latch mechanism 100 and an actuator driving mechanism 200 on a base plate 10. The base plate 10 serves as a basis when the door latch apparatus 1 is attached to the trunk lid D, and has a striker receiving groove 11 at a device part corresponding to the striker S of the main body B of the vehicle, i.e., at a lower end part of the base plate 10. The striker receiving groove 11 is a cutout that extends from the lower end of the base plate 10 upwardly, and is positioned and sized so that the striker S can be received and held when the trunk lid D is closed with respect to the vehicle body B.

The latch mechanism 100 serves to engage and hold the striker S when the trunk lid D is closed with respect to the vehicle body B, and has a ratchet shaft 101 and a latch shaft 102 between which the striker receiving groove 11 is formed. The ratchet shaft 101 serves to support a ratchet 110 in a swingable manner with respect to the base plate 10, and is disposed near an open end of the striker receiving groove 11. The latch shaft 102 serves to dispose a latch 120 rotatably with respect to the base plate 10, and is disposed near a rear end of the striker receiving groove 11.

The ratchet 110 of the latch mechanism 100 extends from the ratchet shaft 101 toward the rear end of the striker receiving groove 11, and has a latch engaging portion 111 and a ratchet operating portion 112.

The latch engaging portion 111 is a projection protruding from the side face of the ratchet 110 toward the striker receiving groove 11 near the rear end of the striker receiving groove 11.

The ratchet operating portion 112 is a part further extending beyond the rear end of the striker receiving groove 11, and has a bent edge portion 113. The bent edge portion 113 is a part bent at a substantially right angle in a direction separating from the base plate 10, and is disposed at the outer edge of the ratchet operating portion 112.

The latch 120 of the latch mechanism 100 has an engagement groove 121, a hook portion 122, a first mesh portion 123, a second mesh portion 124, and a latch operating portion 125.

The engagement groove 121 is a cutout directed to approach the latch shaft 102 from the outer peripheral surface of the latch 120, and has sufficient width to receive and hold the striker S. The engagement groove 121 is intersected with the striker receiving groove 11 sequentially from the open end toward the rear end of the striker receiving groove 11 when the latch 120 is counterclockwise rotated on the latch shaft 102 in FIG. 1.

The hook portion 122 is a part positioned on the side of the open end of the striker receiving groove 11 when the engagement groove 121 is intersected with the striker receiving groove 11.

The first mesh portion 123 and the second mesh portion 124 regulate the clockwise rotation of the latch 120 in FIG. 1 when these mesh portions come into contact with the latch engaging portion 111 of the ratchet 110. When the first mesh portion 123 comes into contact with the latch engaging portion 111, the hook portion 122 of the latch 120 is positioned at the open end of the striker receiving groove 11. When the second mesh portion 124 comes into contact with the latch engaging portion 111, the hook portion 122 of the latch 120 is positioned at the rear end of the striker receiving groove 11. With respect to the striker receiving groove 11, the hook portion 122 protrudes to the position where the striker S can be hindered from passing through the striker receiving groove 11 when the latch engaging portion 111 is brought into either of the first mesh portion 123 and the second mesh portion 124.

The latch operating portion 125 extends from a part close to the latch shaft 102 in a manner corresponding to the ratchet operating portion 112 of the ratchet 110. The latch operating portion 125 is provided with a return spring 103 that urges the latch operating portion 125 and the ratchet operating portion 112 in directions in which these operating portions approach each other.

A half lever 105 is used to operate a latch switch 104 in response to the rotation of the latch 120. Before allowing the first mesh portion 123 of the latch 120 to face the latch engaging portion 111 of the ratchet 110, the half lever 105 keeps the latch switch 104 in an OFF state. On the other hand, after allowing the first mesh portion 123 to come into contact with the latch engaging portion 111, the half lever 105 turns the latch switch 104 on. Reference numeral 130 of FIG. 1 designates an open lever used to operate the ratchet 110 with a wire W1 of a key cylinder (not shown) or a wire W2 of an emergency lever (not shown) when the key cylinder or the emergency lever is operated.

On the other hand, the actuator driving mechanism 200 of the door latch apparatus 1 operates the ratchet 110 and the latch 120 by driving an actuator 201, and has an output lever 210 and a cam driving gear 220.

The output lever 210 has a lever shaft 211 at its base end. The output lever 210 can swing on the axis center of the lever shaft 211, and can slide and move the lever shaft 211 along a slide groove 12 by fitting the lever shaft 211 into the slide groove 12 of the base plate 10. The slide groove 12 is formed at the upper edge of the base plate 10, and is shaped like a circular arc that is convex outwardly from the base plate 10.

A lever spring 212 and a cancel lever 230 are provided between the base end of the output lever 210 and the base plate 10. The lever spring 212 lies between the base end of the output lever 210 and the base plate 10, and urges the lever shaft 211 of the output lever 210 so as to be always disposed at the right end (effective operation position) of the slide groove 12.

The cancel lever 230 is a plate-like member curved along the slide groove 12 of the base plate 10, and is disposed on the base plate 10 in a swingable manner on a cancel shaft 231 provided near the right end of the slide groove 12. The cancel lever 230 is provided with a cancel spring (elastic means) 232 between the base plate 10 and the cancel lever 230. The cancel spring 232 exerts an urging force so that the curved inner surface of the cancel lever 230 comes into contact with and presses the peripheral surface of the lever shaft 211. The cancel spring 232 has a spring constant sufficiently greater than the lever spring 212 mentioned above.

A supporting projection 233 is formed at a part corresponding to the right end of the slide groove 12 on the curved inner surface of the cancel lever 230. When the lever shaft 211 of the output lever 210 is positioned at the right end of the slide groove 12, the supporting projection 233 is brought into contact with the left peripheral surface thereof, and regulates the leftward sliding of the lever shaft 211.

The output lever 210 is provided with a release lever portion 213 and a latch pin 214 at its forefront between the ratchet operating portion 112 and the latch operating portion 125. The release lever portion 213 is a lever-like part provided in such a manner as to face the bent edge portion 113 of the ratchet operating portion 112 from the forefront of the output lever 210. When the output lever 210 swings on the axis center of the lever shaft 211, the release lever portion 213 can press the ratchet 110 through the bent edge portion 113 and the ratchet operating portion 112. The latch pin 214 is a pillar-shaped part protruding from the forefront of the output lever 210. When the output lever 210 swings on the axis center of the lever shaft 211, the latch pin 214 can press the latch 120 through the latch operating portion 125.

The cam driving gear 220 is rotatably disposed at a part corresponding to the intermediate part of the output lever 210 in the base plate 10. When the actuator 201 is driven, the cam driving gear 220 appropriately rotates in a direction through a gear train 240. According to the present embodiment, the cam driving gear 220 rotates in a clockwise direction in FIG. 1. The cam driving gear 220 is provided with a cam pin 221 at its end surface that faces the output lever 210. The cam pin 221 protrudes from the end surface of the cam driving gear 220, and is linked to a cam groove 215 formed at the intermediate part of the output lever 210. When the cam driving gear 220 rotates clockwise, the cam groove 215 allows the ratchet 110 and the latch 120 to sequentially perform a series of operations, described later, through the release lever portion 213 and the latch pin 214.

According to the present embodiment, an electric motor including an output shaft provided with a worm gear is used as the actuator 201, whereas a gear train provided with a worm wheel that meshes with this worm gear is used as the gear train 240 although not shown in the figures. A rotary switch 250 detects a change in position of the cam pin 221 that occurs in accordance with the rotation of the cam driving gear 220.

FIGS. 5 to 10 are schematics for sequentially illustrating an operation of the door latch apparatus 1.

Figure 5:
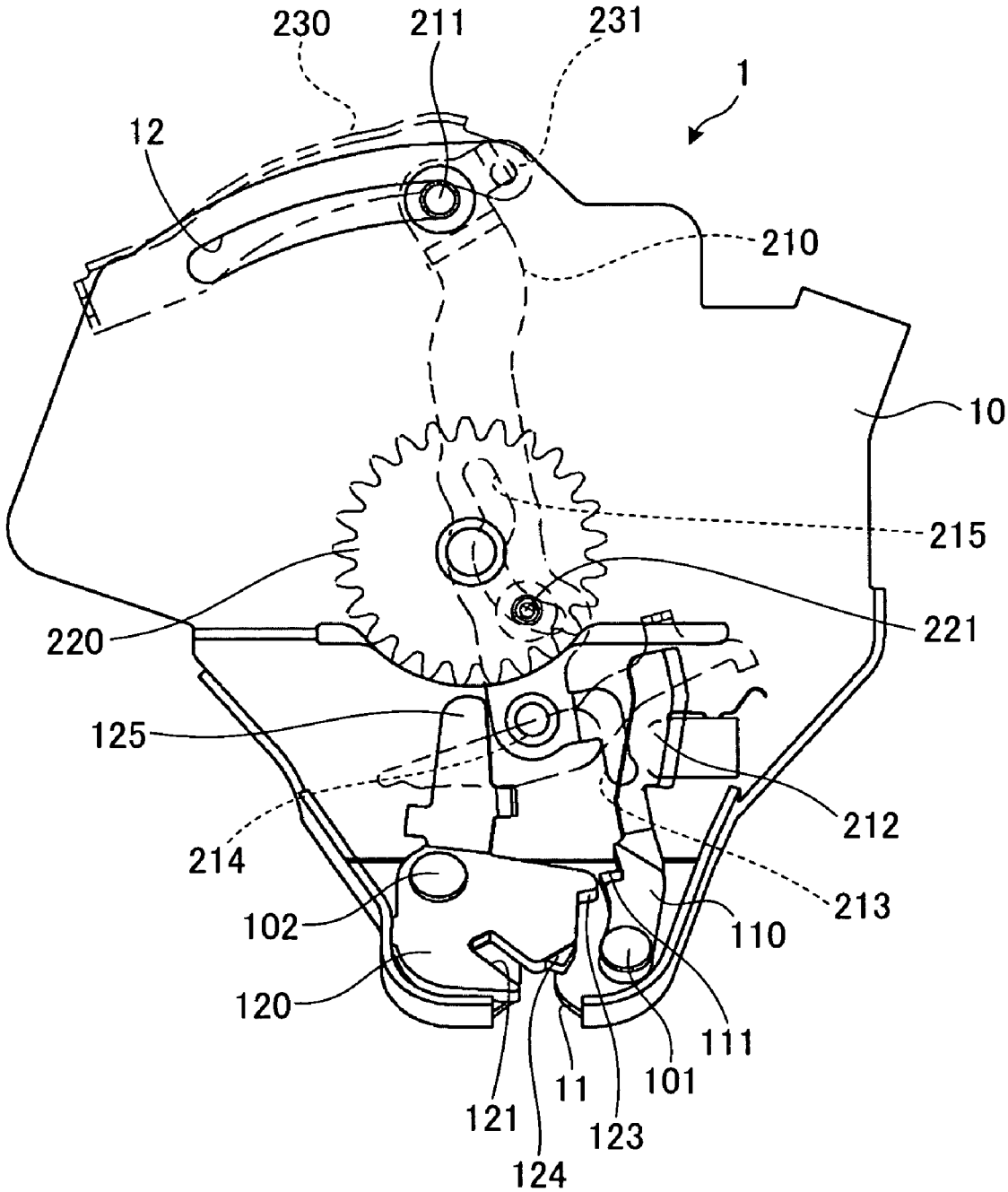
FIG. 5 is a schematic for illustrating an operation of the door latch apparatus (part 1)

In the door latch apparatus 1, when the trunk lid D is in the open state, the latch 120 is positioned at a limit point as a result of rotating clockwise to the utmost limit, and the first mesh portion 123 of the latch 120 and the latch engaging portion 111 of the ratchet 110 are in a state of having not yet faced each other as shown in FIG. 5. At this time, the open end of the engagement groove 121 formed in the latch 120 is opened toward the open end of the striker receiving groove 11 formed in the base plate 10, and is inclined with respect to the striker receiving groove 11. In the output lever 210, the lever shaft 211 is disposed at the right end of the slide groove 12, and the release lever portion 213 and the latch pin 214 provided at the forefront thereof are disposed apart from the ratchet operating portion 112 and the latch operating portion 125, respectively.

When the trunk lid D is opened from the state of FIG. 5, the striker S provided on the main body B of the vehicle enters the striker receiving groove 11 of the base plate 10, and enters the engagement groove 121 of the latch 120. When the striker S proceeds along the striker receiving groove 11 and reaches the rear end thereof in accordance with the closing operation of the trunk lid D, the latch 120 having the engagement groove 121 being in the inclined state with respect to the striker receiving groove 11 is pushed by the striker S, and rotates clockwise upon the axis center of the latch shaft 102.

During this time, the side surface of the ratchet 110 is being in contact with the peripheral surface of the latch 120 while being pressed by the elastic force of the return spring 103, and in a short time, the latch engaging portion 111 comes into contact with the first mesh portion 123 of the latch 120.

Figure 6:
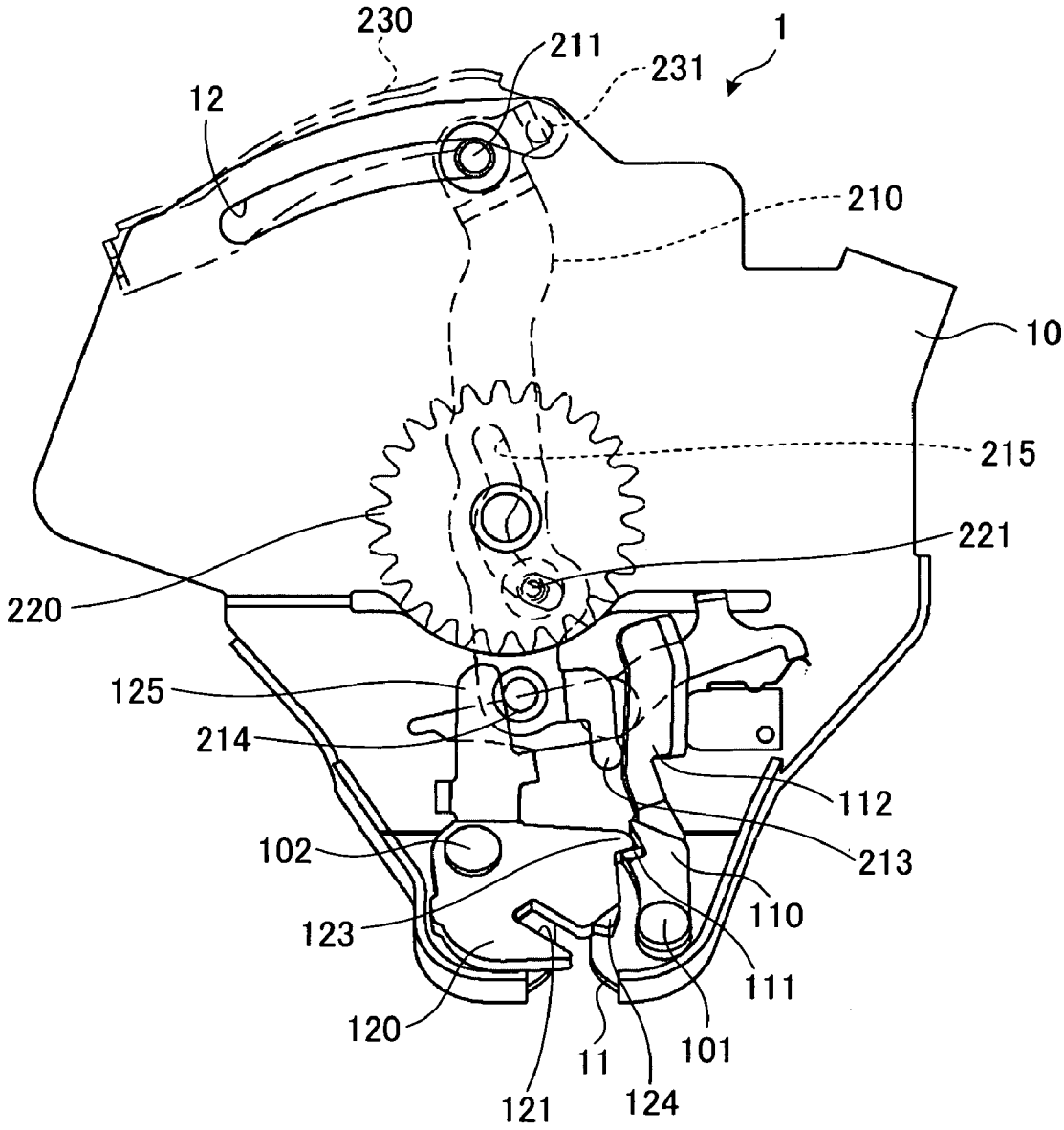
FIG. 6 is a schematic for illustrating an operation of the door latch apparatus (part 2)

In the state in which the latch engaging portion 111 of the ratchet 110 is in contact with the first mesh portion 123 of the latch 120, a restriction is imposed on the clockwise rotation of the latch 120 upon the latch shaft 102 against the elastic restoring force of the return spring 103 as shown in FIG. 6, and the striker S is prevented from deviating from the striker receiving groove 11 by engaging the hook portion 122 of the latch 120 with the striker S. As a result, the door latch apparatus 1 and the striker S bring the trunk lid D into not a completely closed state but a half-latch state (first engagement state), in which the movement in the opening direction is regulated, with respect to the main body B of the vehicle.

When the half-latch state of FIG. 6 is detected by the latch switch 104 through the half lever 105, the actuator 201 of the door latch apparatus 1 is driven. Accordingly, the cam driving gear 220 rotates clockwise, and the output lever 210 starts swinging clockwise upon the axis center of the lever shaft 211 while undergoing the action of the cam pin 221 and the action of the cam groove 215 (effective operation). As a result, the latch pin 214 of the output lever 210 presses the latch operating portion 125 of the latch 120, whereby the latch 120 rotates counterclockwise upon the latch shaft 102. In this case, although the latch engaging portion 111 of the ratchet 110 is being in contact with the first mesh portion 123 of the latch 120, the latch engaging portion 111 never hinders the latch 120 from rotating counterclockwise.

Figure 7:
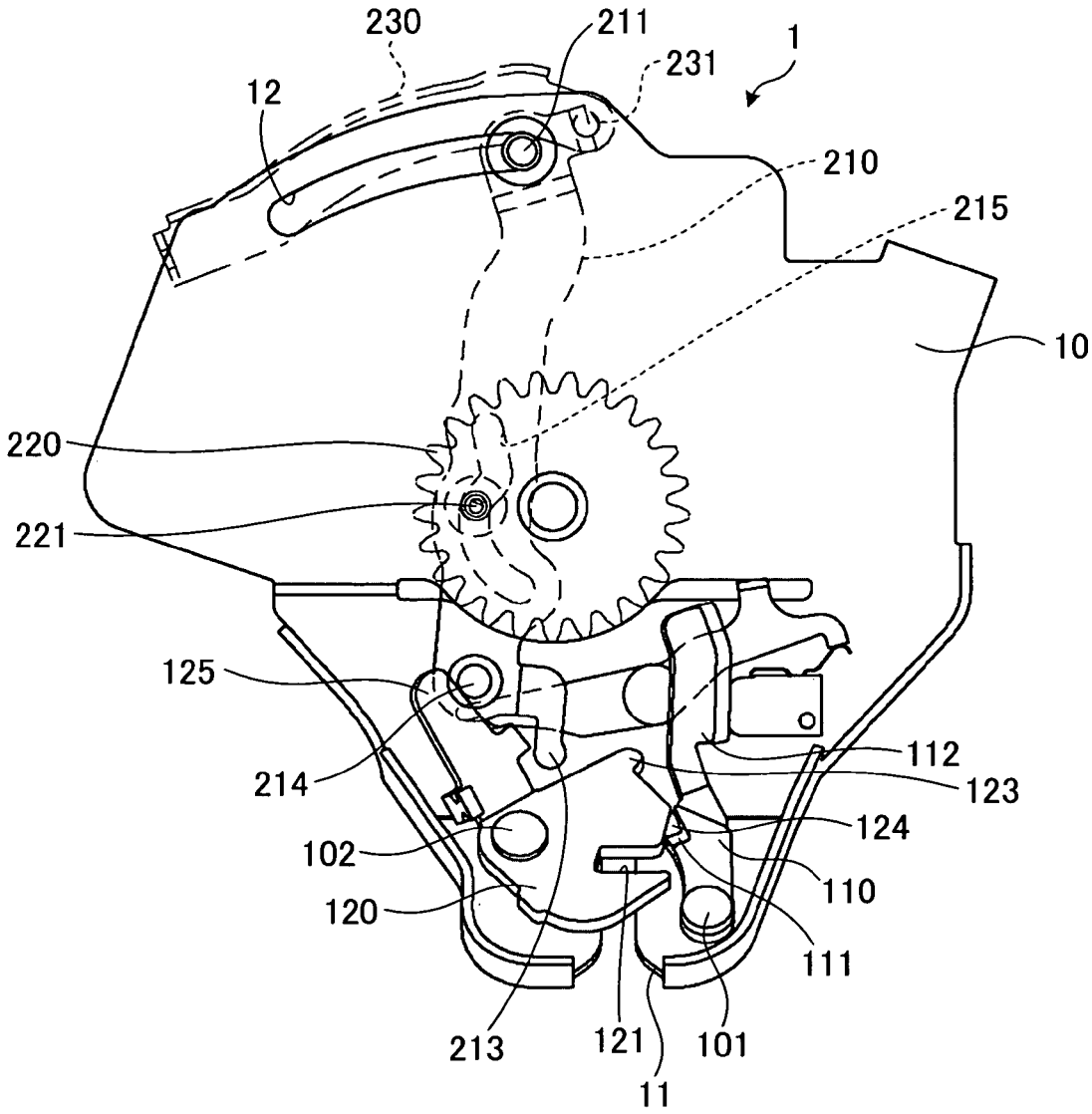
FIG. 7 is a schematic for illustrating an operation of the door latch apparatus (part 3)

When the latch 120 rotates counterclockwise from the half-latch state, the latch engaging portion 111 comes into contact with the second mesh portion 124 of the latch 120 in a short time. In the state in which the latch engaging portion 111 of the ratchet 110 is in contact with the second mesh portion 124 of the latch 120, a restriction is imposed on the clockwise rotation of the latch 120 upon the latch shaft 102 against the elastic restoring force of the return spring 103 as shown in FIG. 7, and the striker S is prevented from deviating from the striker receiving groove 11 by engaging the hook portion 122 of the latch 120 with the striker S. During the time from the state of FIG. 6 to the state of FIG. 7, the latch 120 operates so as to draw the striker S into the rear end of the striker receiving groove 11. As a result, the door latch apparatus 1 and the striker S completely close the trunk lid D with respect to the main body B of the vehicle, and bring the trunk lid D into a full-latch state (second engagement state) in which the movement in the opening direction is regulated.

In a conventional door latch apparatus, in most cases, the shift time from the half-latch state to the full-latch state is set at two seconds or so. In contrast, in the door latch apparatus 1 according to the present embodiment, the actuator 201 and the gear train 240 are designed so that the shift time from the half-latch state to the full-latch state exceeds five seconds.

Figure 8:
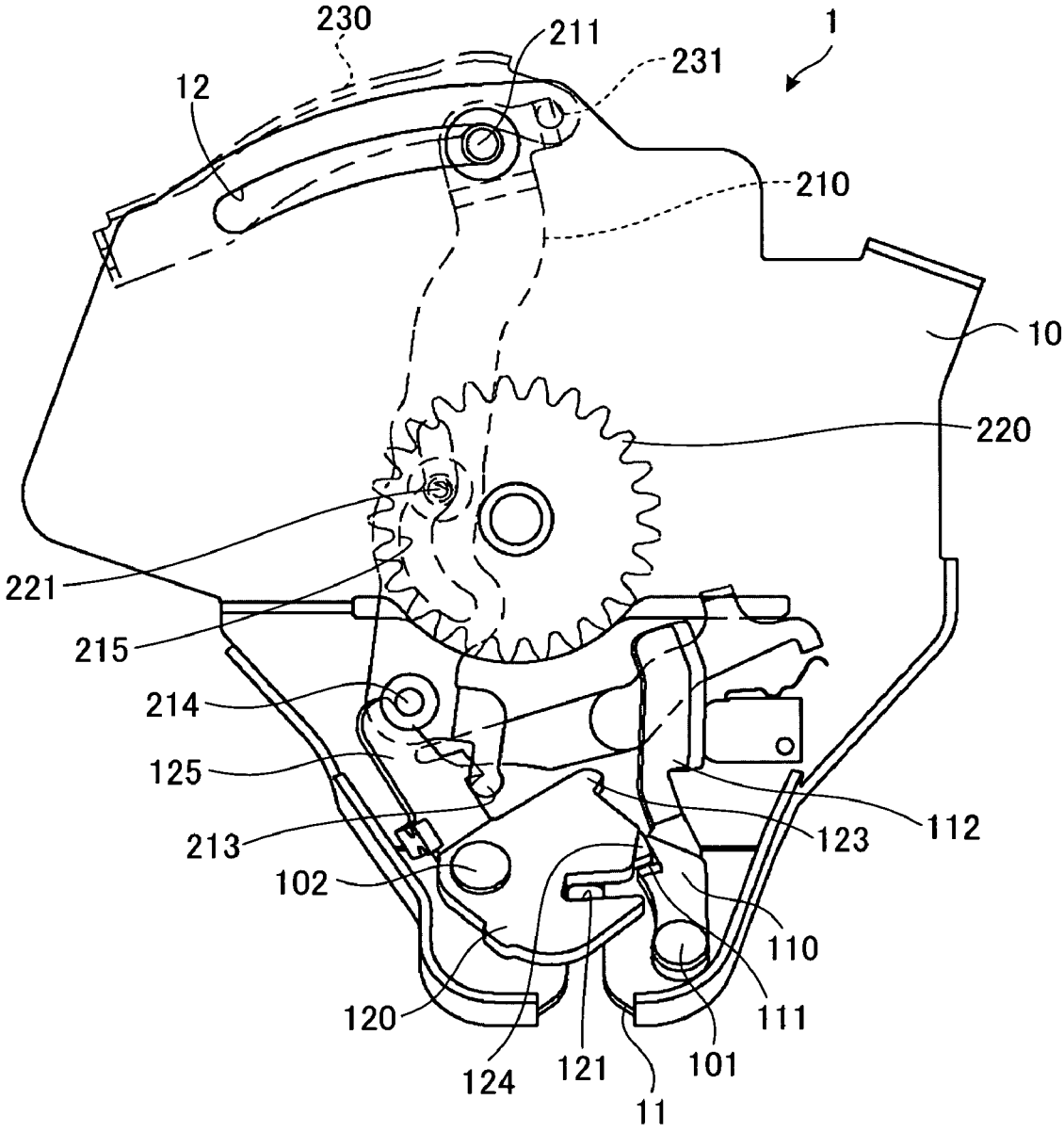
FIG. 8 is a schematic for illustrating an operation of the door latch apparatus (part 4)

In the door latch apparatus 1, after the full-latch state of FIG. 7 is reached, the output lever 210 is further swung in the same direction as shown in FIG. 8, and a shift is performed to a latch-side overstroke state to reliably bring the latch engaging portion 111 of the ratchet 110 into contact with the second mesh portion 124 of the latch 120. Thereafter, the actuator 201 stops being driven in accordance with, for example, a signal sent from the rotary switch 250 in a state of having returned from the latch-side overstroke state to the full-latch state.

Figure 9:
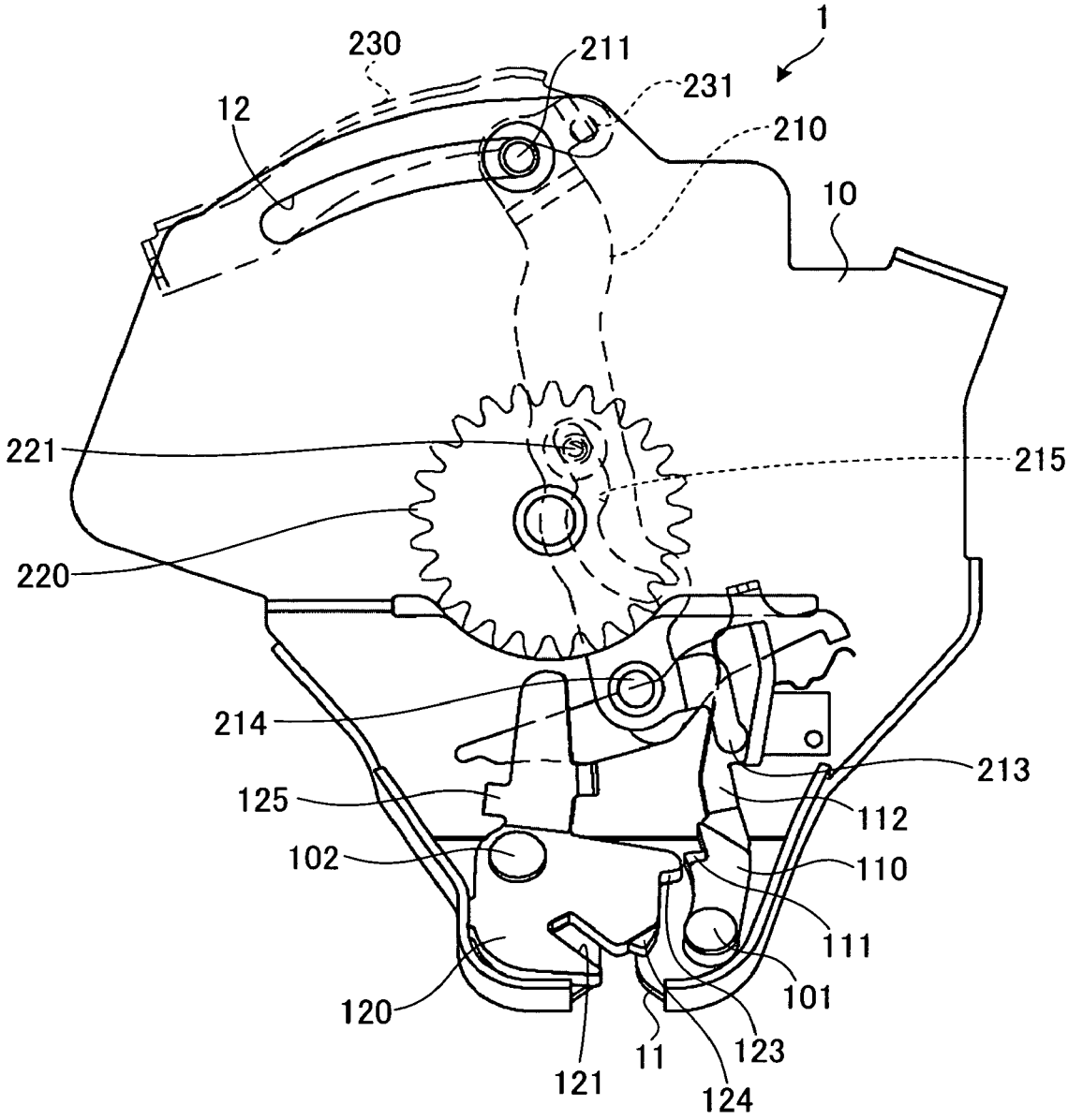
FIG. 9 is a schematic for illustrating an operation of the door latch apparatus (part 5)

On the other hand, for example, when a driver turns on a trunk-opening switch provided in the vehicle interior in the full-latch state of FIG. 7, the cam driving gear 220 rotates clockwise by driving the actuator 201 of the door latch apparatus 1, and the output lever 210 starts swinging counterclockwise upon the axis center of the lever shaft 211. When the output lever 210 swings counterclockwise, the ratchet 110 swings clockwise upon the ratchet shaft 101 against the elastic force of the return spring 103 by allowing the release lever portion 213 of the output lever 210 to press the ratchet operating portion 112 of the ratchet 110. Accordingly, the contact between the second mesh portion 124 of the latch 120 and the latch engaging portion 111 is released as shown in FIG. 9. As a result, the latch 120 rotates clockwise upon the latch shaft 102 by the elastic restoring force of the return spring 103, and hence the striker S recedes from the striker receiving groove 11 of the base plate 10, so that the trunk lid D can be moved and opened.

Figure 10:
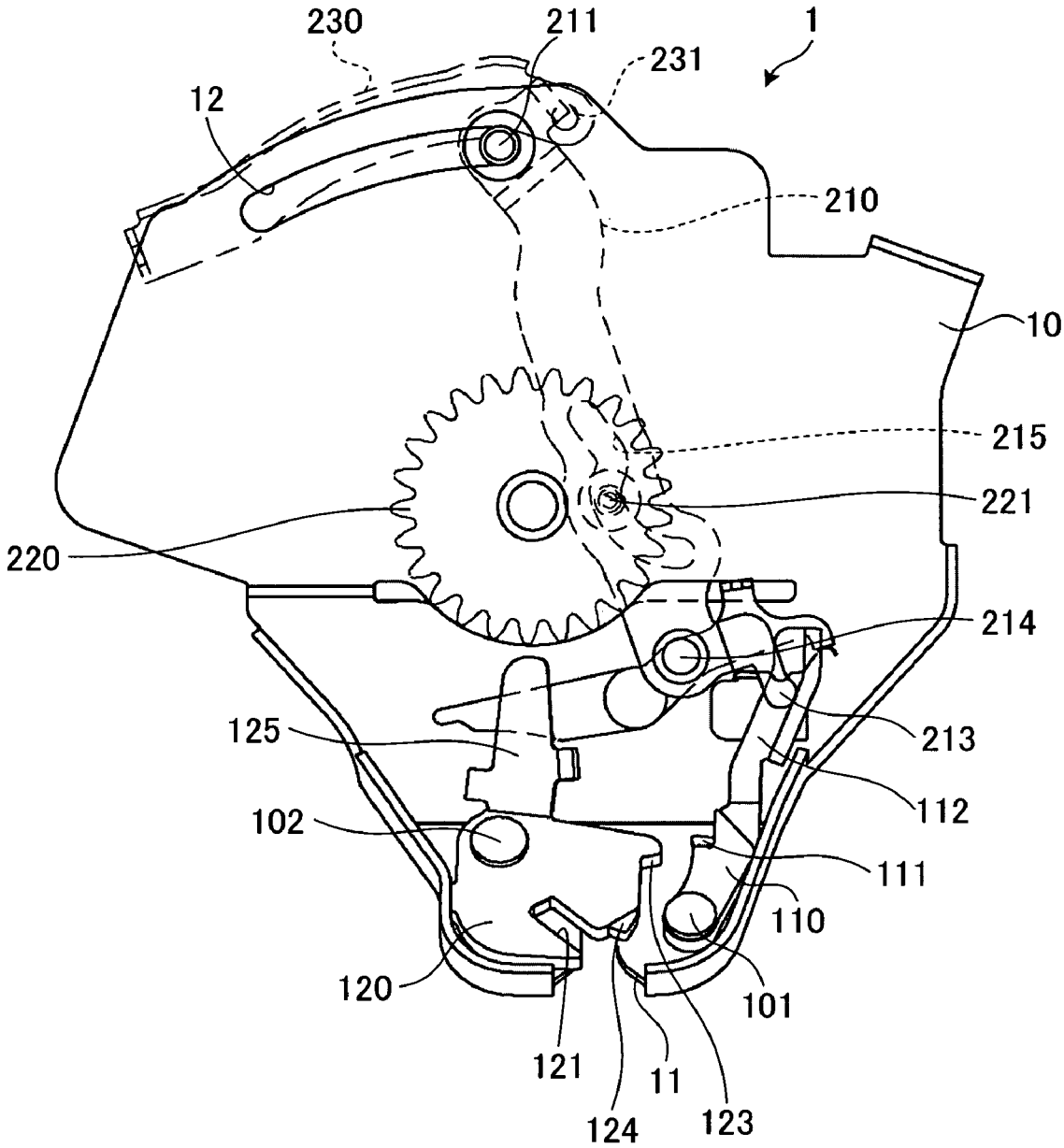
FIG. 10 is a schematic for illustrating an operation of the door latch apparatus (part 6)

In the door latch apparatus 1, after the state of FIG. 9 is reached, the output lever 210 is further swung in the same direction as shown in FIG. 10, and a shift is performed to a release-side overstroke state to reliably release the contact between the second mesh portion 124 of the latch 120 and the ratchet 110. Thereafter, when the return to the state of FIG. 5 is confirmed in accordance with, for example, a signal sent from the rotary switch 250, the actuator 201 stops being driven.

After that, the operations shown in FIGS. 5 to 10 are repeatedly performed, and it becomes possible to control the opening and closing of the trunk lid D with respect to the main body B of the vehicle. When a key cylinder or an emergency lever, not shown, are operated in the full-latch state of FIG. 7, the open lever 130 swings counterclockwise through a wire W1 of the key cylinder or a wire W2 of the emergency lever, and the ratchet 110 swings clockwise upon the ratchet shaft 101 against the elastic force of the return spring 103. As a result, the contact between the second mesh portion 124 of the latch 120 and the latch engaging portion 111 is released, so that the trunk lid D can be moved and opened.

Even in the door latch apparatus 1, for example, if a foreign object is nipped between the main body B of the vehicle and the trunk lid D, it will become difficult to bring the latch 120 into the full-latch state from the half-latch state, as in the conventional device.

Figure 11:
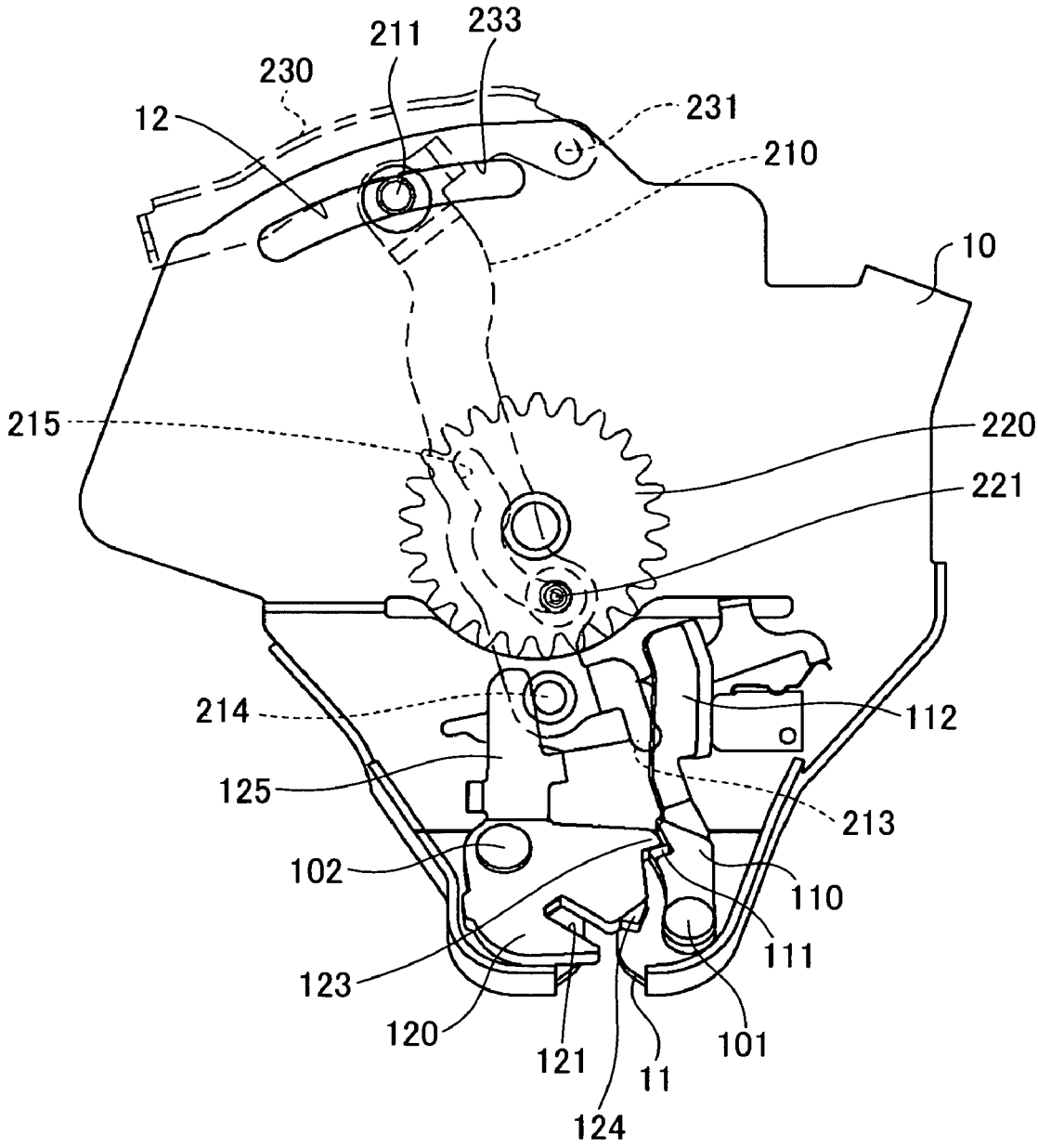
FIG. 11 is a schematic for illustrating an operation of the door latch apparatus (part 7)
Figure 12:
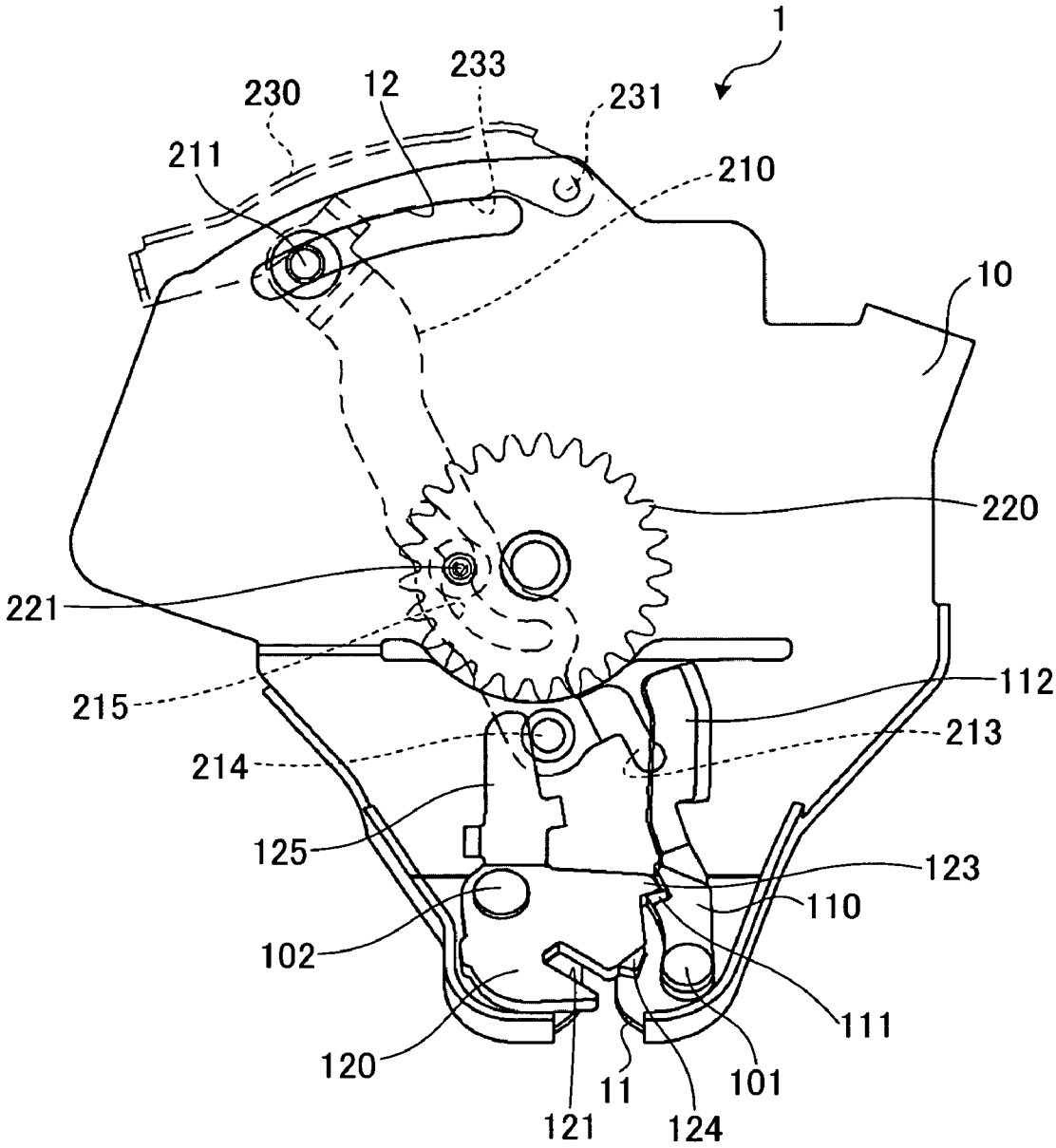
FIG. 12 is a schematic for illustrating an operation of the door latch apparatus (part 8)

However, in the door latch apparatus 1 according to the present embodiment, when the cam driving gear 220 rotates clockwise after the latch 120 reaches a stationary state, the intermediate part of the latch 120 is pressed leftwards in the figures, and, in a short time, the lever shaft 211 of the output lever 210 goes beyond the supporting projection 233 against the elastic force of the cancel spring 232 and the elastic force of the lever spring 212. As a result, as shown in FIGS. 11 and 12, the slide groove 12 of the base plate 10 is slid toward the left end, centering on the axis center of the latch pin 214 (retracting operation). Therefore, even when the latch 120 reaches the stationary state, all of the output lever 210, the cam driving gear 220, and the gear train 240 through which the power from the actuator 201 is transmitted to the latch 120 can operate, and hence an overload is never imposed these elements, and there is no fear that these will be damaged.

Figure 13:
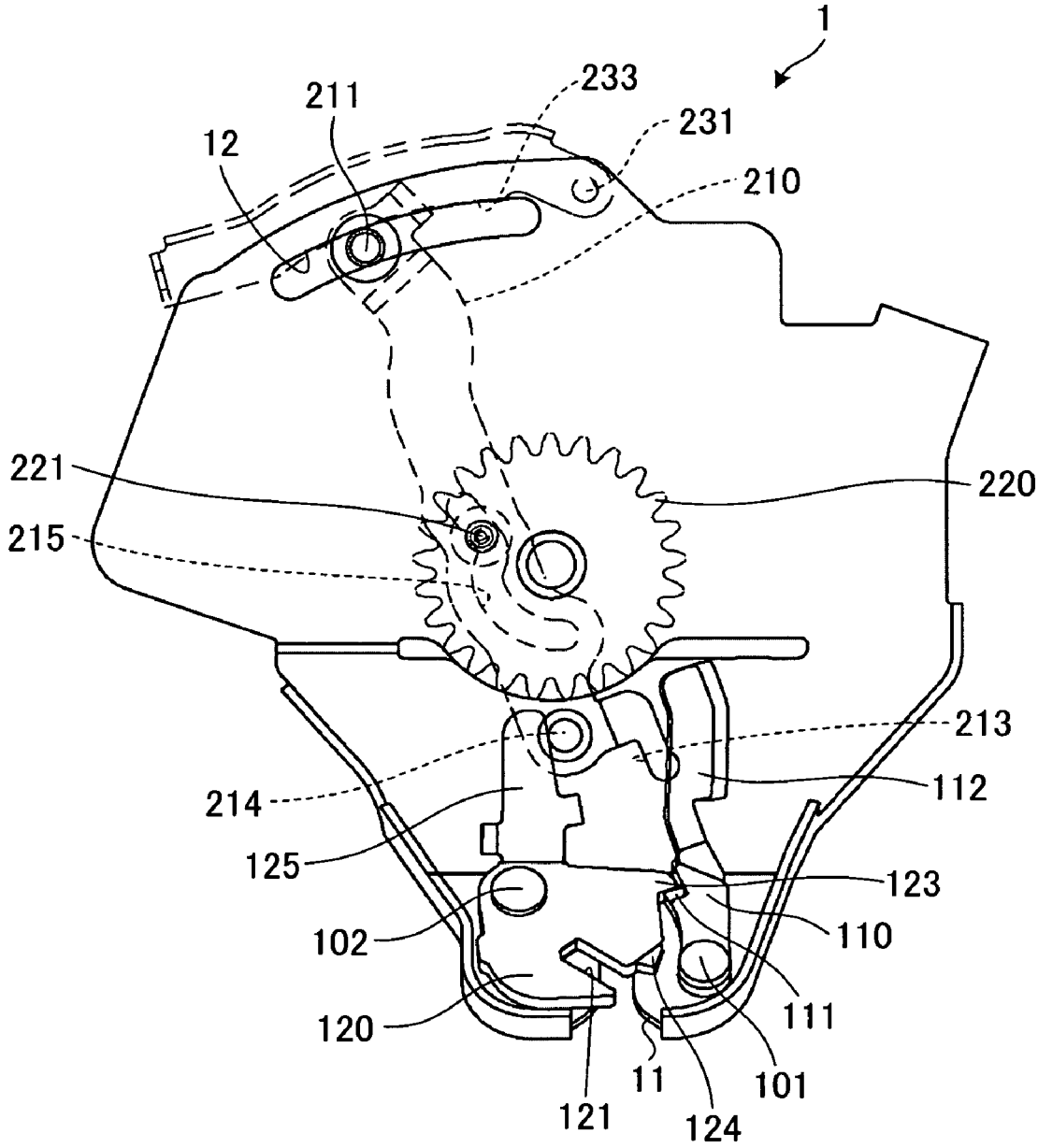
FIG. 13 is a schematic for illustrating an operation of the door latch apparatus (part 9)
Figure 14:
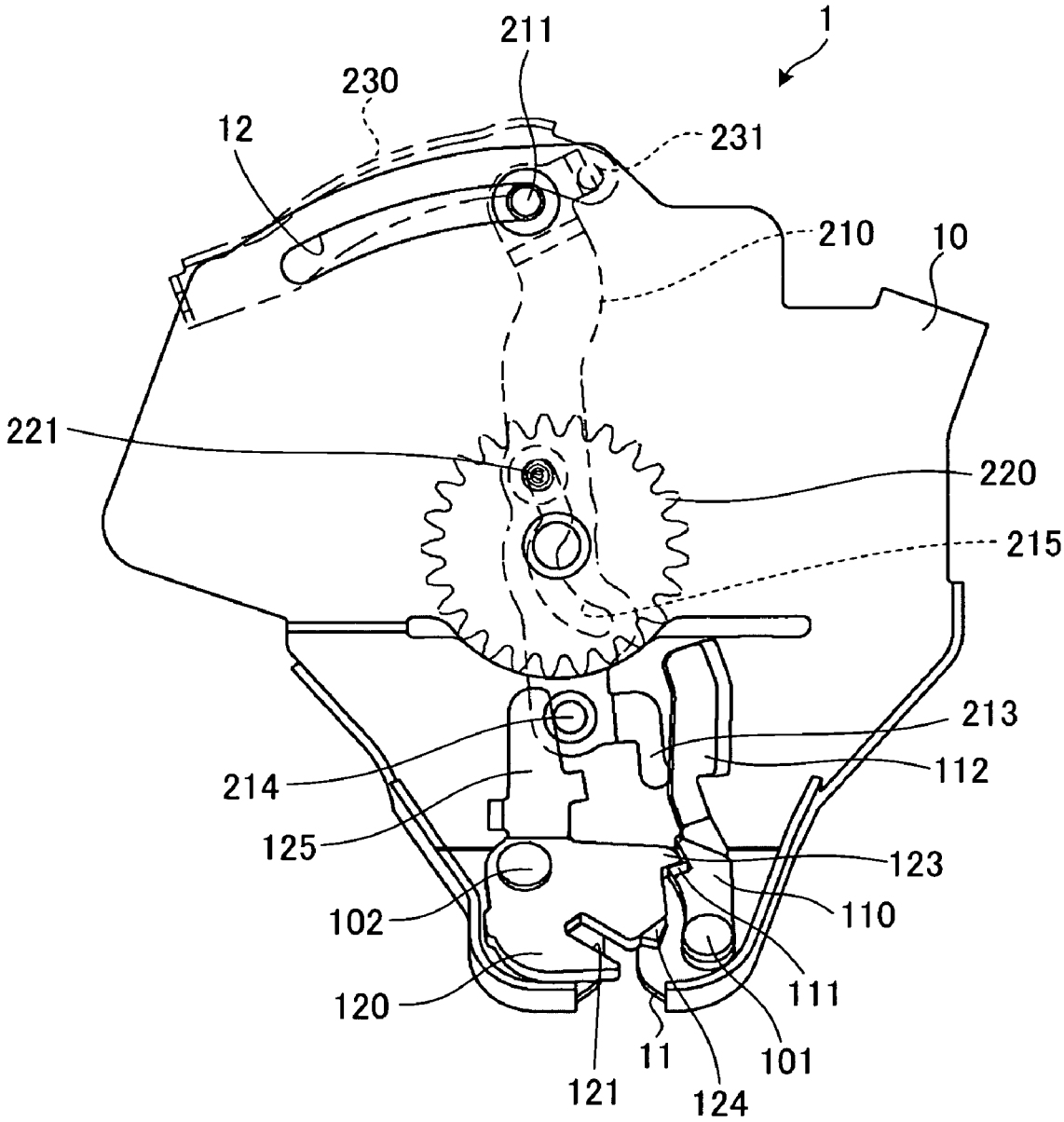
FIG. 14 is a schematic for illustrating an operation of the door latch apparatus (part 10)

When the cam driving gear 220 rotates, the lever shaft 211 that has slid along the slide groove 12 is again kept in the state of having returned to the right end of the slide groove 12 with cooperation between the cam pin 221 and the cam groove 215 as shown in FIGS. 13 and 14. Therefore, when the trunk opening switch is turned on from this state, the contact between the second mesh portion 124 of the latch 120 and the latch engaging portion 111 is released as shown in FIGS. 9 and 10, so that the trunk lid D can be moved and opened, and hence a foreign object nipped between the main body B of the vehicle and the trunk lid D can be removed.

Figure 15:
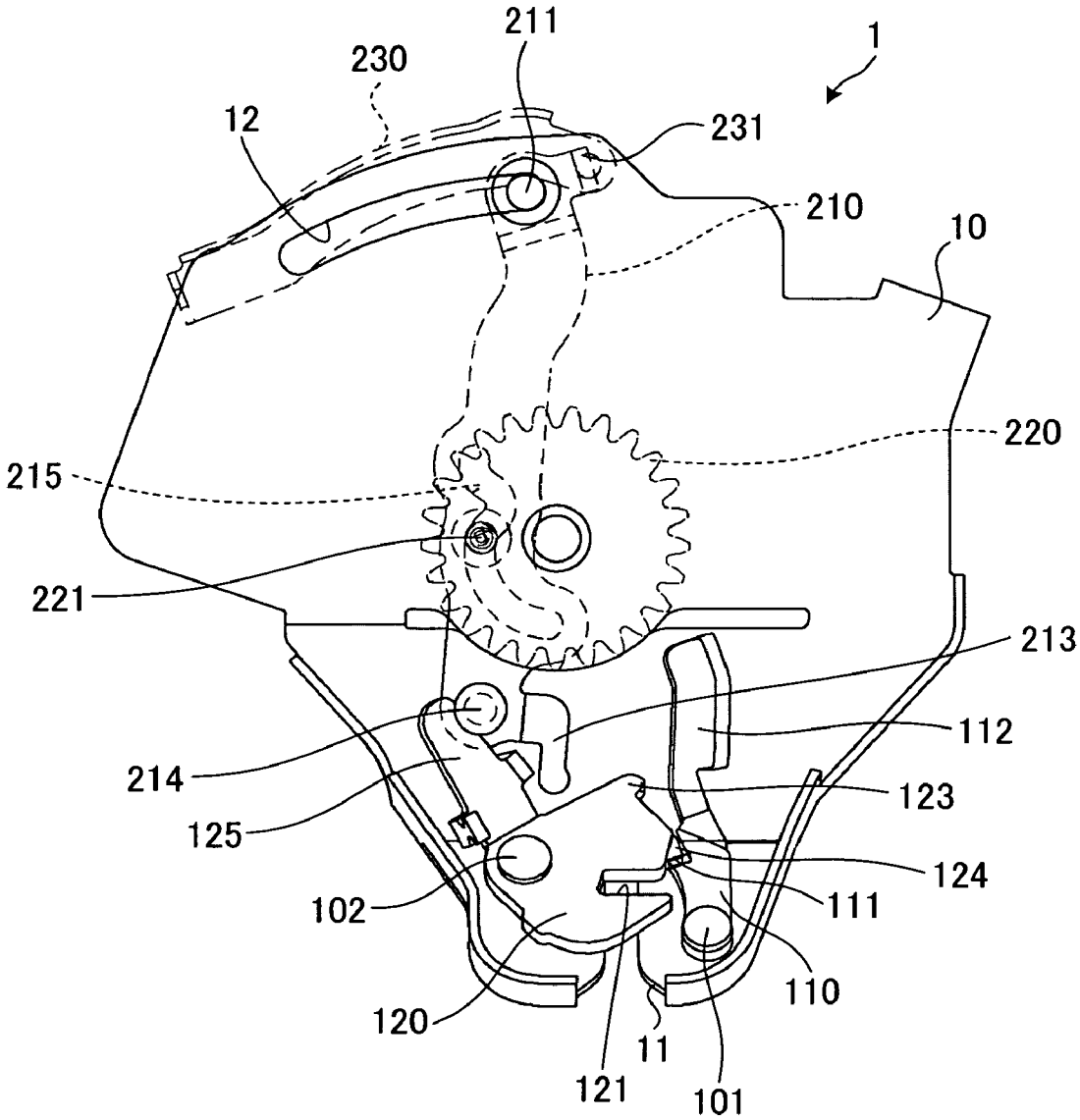
FIG. 15 is a schematic for illustrating an operation of the door latch apparatus (part 11)
Figure 16:
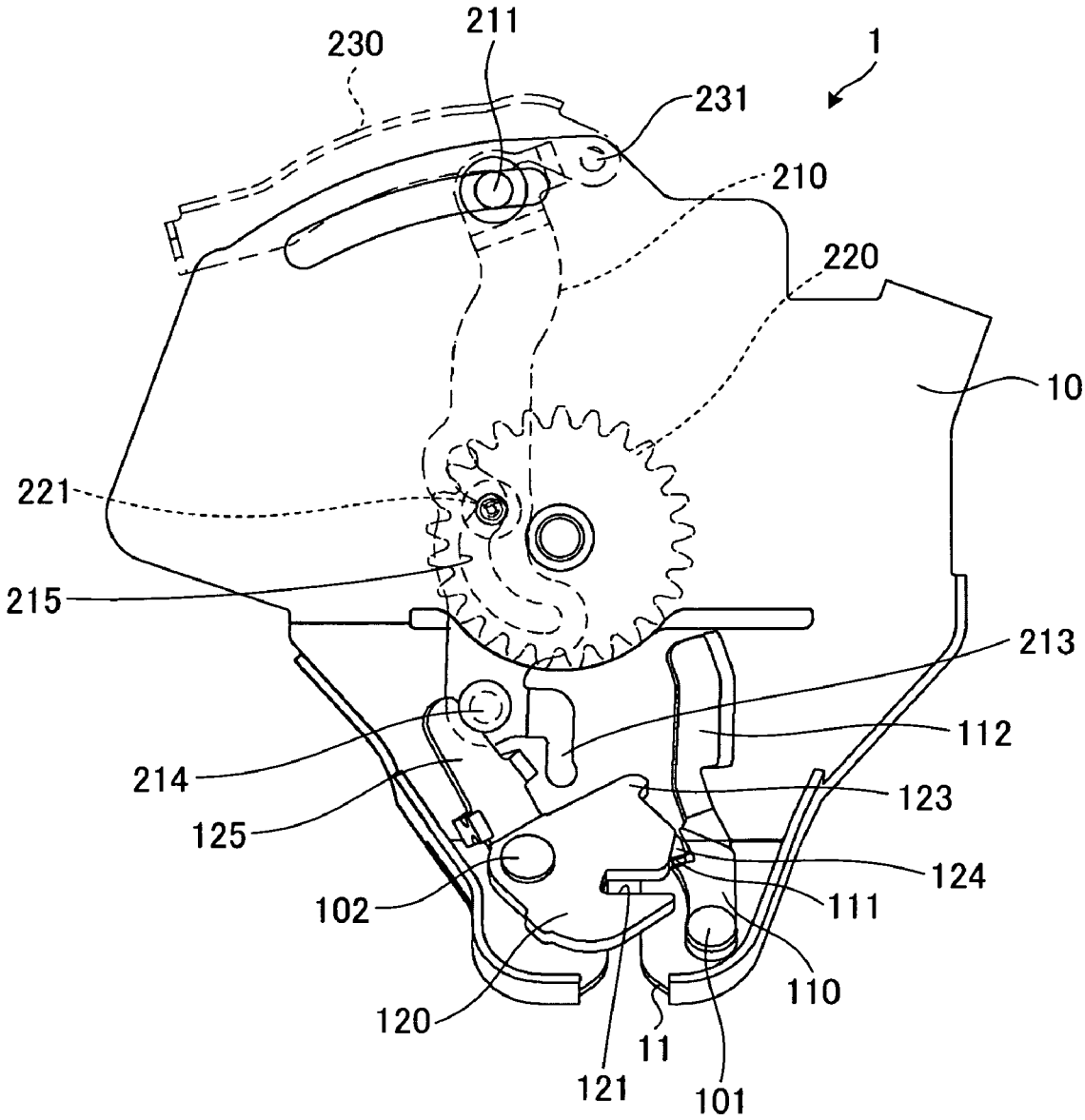
FIG. 16 is a schematic for illustrating an operation of the door latch apparatus (part 12).

Not only when the shift from the half-latch state to the full-latch state is regulated, but also when the shift from the full-latch state to the latch-side overstroke state is regulated as shown in FIGS. 15 and 16, the retracting operation according to the sliding of the lever shaft 211 is set to be performed in the same way. In other words, even when the shift to the latch-side overstroke state by which a new second engagement state is reached is regulated after the full-latch state is reached, the lever shaft 211 of the output lever 210 is set to be slid along the slide groove 12 of the base plate 10 by driving the actuator 201. Therefore, if the foreign object nipped between the main body B of the vehicle and the trunk lid D is relatively flexible or thin, and even if the shift from the full-latch state to the latch-side overstroke state is regulated in spite of the fact that the shift from the half-latch state to the full-latch state has been performed, there is no fear that the gear train 240, the cam driving gear 220, and the output lever 210 will be damaged.

According to the present embodiment, the door latch apparatus 1 provided between the main body B of the vehicle and the trunk lid D has been described. However, the present invention can also be applied to a door latch apparatus that keeps other doors in a closed state. This door latch apparatus is suitable especially for a door having no door handle as in the present embodiment.

Furthermore, according to the present embodiment, a description has been provided of the door latch apparatus 1 in which the shift from the half-latch state to the full-latch state and the release of the full-latch state are performed by rotating the cam driving gear 220 in the same direction. However, the present invention is not necessarily limited to the release of the full-latch state if the shift from the half-latch state to the full-latch state is performed.

Moreover, according to the present embodiment, the striker S is provided on the main body B of the vehicle, whereas the door latch apparatus 1 is provided on the door D. However, the striker S and the door latch apparatus can be provided in a reverse manner. Still additionally, the striker S and the latch 120 are shifted from the first engagement state to the second engagement state by driving the actuator 201 so as to actuate the latch 120 engaged with the striker S fixed to the vehicle body B. However, the door latch apparatus can be structured so that a striker and the latch are changed from the first engagement state to the second engagement state by driving the actuator so as to actuate the striker engaged with the latch provided on the vehicle body.

Furthermore, according to the present embodiment, the actuator 201 is driven when the half-latch state, which is the first engagement state, is reached. However, the actuator 201 does not need to be driven when the first engagement state is reached. For example, the actuator to effectively actuate the output lever can be driven at an arbitrary time point between the rotation of the latch by the striker and the first engagement state or after a predetermined time has passed from the half-latch state. In other words, if the actuator is driven when the first engagement state is reached, the time when the actuator is driven does not need to be caused to coincide with the time when the first engagement state is reached.

According to the present invention, even when a foreign object is nipped between the vehicle body and the vehicle door so that a shift from the first engagement state to the second engagement state of the striker and the latch becomes difficult, the retracting operation of the output lever makes it possible to prevent a situation in which an overload is applied, and to dismiss a fear that the door latch apparatus will be damaged.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A door latch apparatus configured to close a door of a vehicle, comprising:

a latch configured to engage with a striker;

an actuator;

a base plate;

a slide groove formed on the base plate including a first groove end and a second groove end;

an output lever including a first end, a second end, and a mid part, wherein the first end includes a lever shaft which is held at the first groove end or slid in a first direction from the first groove end toward the second groove end, wherein the second end of the output lever is configured to swing in a clockwise and a counterclockwise direction centering on an axis center of the lever shaft and is configured to press the latch when the output lever swings in the clockwise direction when a movement of the actuator acts on the mid part of the output lever;

a cancel lever configured to be a plate member curved along the slide groove, and is disposed on the base plate, wherein the cancel lever is provided with a first elastic member between the base plate and the cancel lever, wherein the first elastic member is configured to exert an urging force so that a curved inner surface of the cancel lever comes into contact with a peripheral surface of the lever shaft and presses the peripheral surface of the lever shaft; and a supporting projection that is pressed toward the lever shaft via the first elastic force of the first elastic member and configured to regulate the lever shaft to slide from the first groove end toward the second groove end, wherein the striker and the latch are shifted from a first engagement state into a second engagement state by the movement of the actuator which causes the output lever to swing in the clockwise direction centering on the axis center of the lever shaft located at the first groove end if the shift of the striker and the latch into the second engagement state is not restricted, and wherein the movement of the actuator causes the output lever to swing, centering on an axis center of the second end, when the shift of the striker and the latch into the second engagement state is restricted so that the lever shaft is slid in the first direction beyond the supporting projection against the first elastic force.

2. The door latch apparatus according to claim 1, wherein the supporting projection protrudes into the slide groove via the first elastic force of the first elastic member.

3. The door latch apparatus according to claim 2, wherein the lever shaft is held at the first groove end by a second elastic force of a second elastic member, and the lever shaft is slid in the first direction along the slide groove against the second elastic force when the shift of the striker and the latch into the second engagement state is restricted.

4. The door latch apparatus according to claim 3, wherein the second elastic member has a second spring constant, and the first elastic member has a first spring constant greater than the second spring constant.

5. The door latch apparatus according to claim 3, wherein the slide groove has a circular arc shape.

6. The door latch apparatus according to claim 2, wherein the slide groove has a circular arc shape.

7. The door latch apparatus according to claim 1, wherein the first engagement state of the striker and the latch corresponds to a half-latch state, and the second engagement state of the striker and the latch corresponds to a full-latch state.

8. The door latch apparatus according to claim 1, wherein the first engagement state of the striker and the latch corresponds to a full-latch state, and the second engagement state of the striker and the latch corresponds to a release-side overstroke state.

9. The door latch apparatus according to claim 1, wherein the striker and the latch are maintained to be engaged while the lever shaft is slid in the first direction beyond the supporting projection.

10. A door latch apparatus configured to close a door of a vehicle, comprising:

a latch configured to engage with a striker;

an actuator;

a base plate;

a slide groove including a first groove end and a second groove end, wherein a first direction corresponds to a direction from the first groove end toward the second groove end;

a cancel lever configured to be a plate member curved along the slide groove, and is disposed on the base plate, wherein the cancel lever is provided with a first elastic member between the base plate and the cancel lever, wherein the first elastic member is configured to exert an urging force so that a curved inner surface of the cancel lever comes into contact with and presses a peripheral surface of a lever shaft; and an output lever including a first end, a second end, and a mid part, wherein the first end includes the lever shaft which is disposed in the slide groove, and held at the first groove end via the elastic force of the elastic member or slid in the first direction, wherein the second end presses the latch when the output lever swings in a clockwise direction centering on an axis center of the lever shaft when a movement of the actuator acts on the mid part of the output lever, wherein the striker and the latch are shifted from a first engagement state into a second engagement state by the movement of the actuator which causes the output lever to swing in the clockwise direction centering on the axis center of the lever shaft located at the first groove end if the shift of the striker and the latch into the second engagement state is not restricted, and wherein the movement of the actuator causes the output lever to swing, centering on an axis center of the second end of the output lever, when the shift of the striker and the latch into the second engagement state is restricted so that the lever shaft is slid in the first direction along the slide groove against the elastic force.

11. The door latch apparatus according to claim 10, wherein the first engagement state of the striker and the latch corresponds to a half-latch state, and the second engagement state of the striker and the latch corresponds to a full-latch state.

12. The door latch apparatus according to claim 10, wherein the first engagement state of the striker and the latch corresponds to a full-latch state, and the second engagement state of the striker and the latch corresponds to a release-side overstroke state.

13. The door latch apparatus according to claim 10, wherein the striker and the latch are maintained to be engaged while the lever shaft is slide in the first direction beyond a supporting projection.

14. The door latch apparatus according to claim 10, wherein the slide groove has a circular arc shape.

* * * * *